US012729540B2

(12) United States Patent
Jorge et al.

(10) Patent No.: US 12,729,540 B2
(45) Date of Patent: Sep. 8, 2026

(54) TRAINING HAND RAIL

(71) Applicants: Michele O. Jorge, Bethlehem, PA (US); Madeline Rodriguez, Bethlehem, PA (US)

(72) Inventors: Michele O. Jorge, Bethlehem, PA (US); Madeline Rodriguez, Bethlehem, PA (US)

( * ) Notice: Subject to any disclaimer, the term of this patent is extended or adjusted under 35 U.S.C. 154(b) by 43 days.

(21) Appl. No.: 18/953,891

(22) Filed: Nov. 20, 2024

(65) Prior Publication Data

US 2025/0075509 A1 Mar. 6, 2025

Related U.S. Application Data

(63) Continuation of application No. 16/552,335, filed on Aug. 27, 2019, now abandoned.

(60) Provisional application No. 62/723,768, filed on Aug. 28, 2018.

(51) Int. Cl.
*E04F 11/18* (2006.01)

(52) U.S. Cl.
CPC ..... *E04F 11/1808* (2013.01); *E04F 11/1804* (2013.01)

(58) Field of Classification Search
CPC ..... E04F 11/1802; E04F 11/1804; E04F 11/1808; E04F 2011/1897
See application file for complete search history.

(56) References Cited

U.S. PATENT DOCUMENTS

| | | | | | |
|---|---|---|---|---|---|
| 4,289,303 | A * | 9/1981 | Hamm | E04F 11/1808 | 256/69 |
| 5,989,708 | A * | 11/1999 | Kreckel | C09J 7/24 | 248/467 |
| 6,176,472 | B1 * | 1/2001 | Burger | E04F 11/1804 | 403/312 |
| 6,209,854 | B1 * | 4/2001 | Sedlack | E04F 11/1863 | 52/848 |
| 2002/0172551 | A1 * | 11/2002 | Greaves | E04F 11/1808 | 403/359.1 |
| 2004/0221539 | A1 * | 11/2004 | Rouail | E04F 19/026 | 52/718.04 |
| 2015/0292212 | A1 * | 10/2015 | Walker | E04F 11/1808 | 256/62 |
| 2016/0010340 | A1 * | 1/2016 | Jozwiak | E04F 11/1804 | 256/65.01 |
| 2020/0318357 | A1 * | 10/2020 | Bennett | E04F 11/1808 | |

FOREIGN PATENT DOCUMENTS

| | | | | |
|---|---|---|---|---|
| DE | 102012100556 A1 * | 8/2012 | ..... | E04F 11/1804 |
| GB | 2500020 A * | 9/2013 | ..... | E04F 11/1808 |

(Continued)

*Primary Examiner* — Joshua T Kennedy
(74) *Attorney, Agent, or Firm* — Duane Morris LLP

(57) ABSTRACT

A system includes an elongated tube, a foam sleeve, and a plurality of supports. The foam sleeve is configured to be positioned around the elongated tube. The plurality of supports are configured to be attached to the elongated tube. Each of the plurality of supports includes a respective flange configured to be mounted against a wall. The elongated tube may comprise a plurality of tubular sections joined end-to-end, each tubular section having a male connector at a first end and a female connector at a second end opposite the first end. The male connector of a first tube is configured to engage a female connector of a second tube.

13 Claims, 10 Drawing Sheets

(56) References Cited

FOREIGN PATENT DOCUMENTS

| | | | | | |
|---|---|---|---|---|---|
| JP | 2006233679 | A | * | 9/2006 | |
| KR | 20220095919 | A | * | 7/2022 | ..... E04F 11/1808 |
| KR | 20240002015 | A | * | 1/2024 | ..... G08B 21/0461 |

* cited by examiner

TRAINING HAND RAIL

CROSS-REFERENCE TO RELATED APPLICATIONS

This application is a continuation of U.S. application Ser. No. 16/552,335, filed Aug. 27, 2019, which application claims priority to U.S. Provisional Patent Application No. 62/723,768, filed Aug. 28, 2018, which is hereby incorporated by reference in its entirety.

FIELD

This disclosure relates generally to assistive devices and more specifically to a handrail for a staircase.

BACKGROUND

Staircases present a significant risk of slip and fall accidents. Such accidents may lead to injuries. This is a particular issue for toddlers and other individuals with poor balance. Further, falling on a staircase may cause a toddler to avoid using stairs.

Several types of handrails and walking aid devices have been disclosed in the prior art. These devices have been aimed at preventing injuries that can occur when a toddler or adult has poor balance and uses the device in order to stabilize their balance.

U.S. Pat. No. 4,556,201 discloses a handrail assembly for the erection of a handrail designed for a toddler or young child, including a set of elongate rail members which can be connected end-to-end to provide a handrail member of a desired length. Two or more elongate hanging devices are used to mount the handrail member below another handrail. The device is capable of being mounted at one end thereof to a wall at a location which is a mounting point for the other handrail. Preferably each hanging device has a support bracket attached to its bottom end, which bracket is connectable to the handrail.

U.S. Pat. No. 6,209,854 discloses a children's handrail assembly consists of four equally spaced connector brackets having three sections of plastic tubing interconnected therebetween. The connector brackets are secured to a standard handrail by means of cable ties which pass through apertures in the connector bracket and pull tightly around the standard handrail. The children's handrail can be applied to either wall mounted, or spindle supported standard handrails. When wall mounted, the connector brackets urge against the wall surface. When spindle mounted, an additional cable tie may be employed to secure the bracket to a spindle.

U.S. Pat. No. 7,032,355 discloses a child's handrail assembly is mounted beneath another handrail and comprises three 6 inch dual pull-lock extension rods; a plurality of durable lightweight 1 inch diameter rods, which can be adjusted to fit any size handrail and connected together by an interlocking coupling. Each dual pull-lock extension rod includes an upper strap that is wrapped around the existing handrail and a lower strap that is wrapped around the lower rods to suspend the lower rods beneath the existing handrail and form a child's handrail.

U.S. Pat. No. 4,823,524 discloses an apparatus for Aiding people in walking up and down stairs. This patent describes an apparatus for aiding a person in walking up and down a staircase which has at least one railing running alongside. The apparatus includes a series of structures which are affixed to the at least one railing for supporting a person's hands and arms and, thereby, a portion of the person's weight.

SUMMARY

In one aspect, a system includes an elongated tube, a foam sleeve, and a plurality of supports. The foam sleeve is configured to be positioned around the elongated tube. The plurality of supports are configured to be attached to the elongated tube. Each of the plurality of supports includes a respective flange configured to be mounted against a wall.

In another aspect, a system includes an elongated plastic tube comprising a plurality of tubular plastic sections joined end-to-end, each tubular plastic section having a male connector at a first end and a female connector at a second end opposite the first end. The male connector of a first tube is configured to engage a female connector of a second tube. The system further comprises a plurality of supports attached to the elongated plastic tube. Each of the plurality of supports includes a respective flange configured to be mounted to a wall.

In another aspect, a method includes assembling a plurality of tubular sections to form an elongated tube. The method further includes positioning one or more sections of foam around the elongated tube. The method further includes attaching the elongated tube to a plurality of supports. The method further includes attaching the plurality of supports to a wall at a first location between a set of steps and a stair rail.

BRIEF DESCRIPTION OF THE DRAWINGS

These and other features of the devices and methods provided herein will be more fully disclosed in, or rendered obvious by, the following detailed description of the preferred embodiments of the invention, which is to be considered together with the accompanying drawings wherein like numbers refer to like parts and further wherein.

DETAILED DESCRIPTION

Figure 1A:
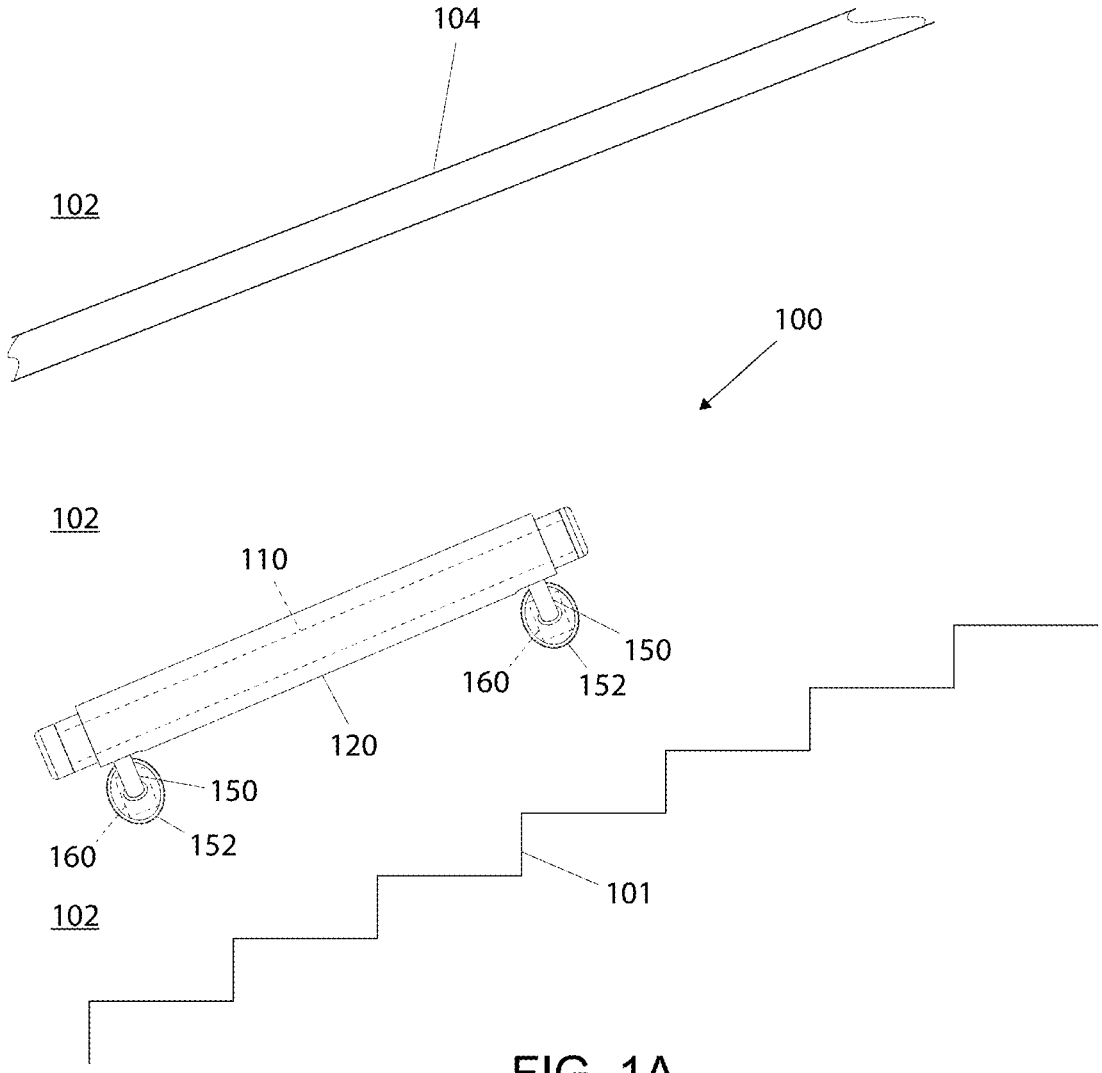
FIG. 1A is a diagram of an installed handrail assembly.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

This disclosure relates to a rail that can be easily installed adjacent to a variety of staircases. Toddlers who are learning to ascend and descend stairs may be able to use such handrails to safely learn to do so. The handrails described herein are designed to facilitate balance. Toddlers and children can use the handrail for guiding and stabilizing themselves to improve the safety of passage on the staircase. The handrails may enhance balance, which may lead to decreased falls and fear of falling. In addition, a child who uses a handrail for every step will often be more secure traversing a set of stairs.

In some applications, it may be beneficial to have a temporary, detachable handrail which has easily adjustable supports and members that allow the handrail to be fitted to various staircases. A temporary rail can be advantageous because it assists the user and can easily be removed and disassembled when the child no longer uses it. Alternatively, as the child grows, the handrail assembly can be detached and re-attached at a greater height above the steps, to accommodate the child's height.

FIG. 1A illustrates a front view of a detachable handrail assembly 100 in the form of a support cylinder. The handrail assembly 100 can be attached to the wall 102, below the permanent handrail 104, at a height suitable for a child learning to climb the stairs 101.

In some embodiments, the handrail assembly 100 comprises at least one length of tubing 110. The tubing 110 can be constructed of any appropriate material, such as, for example, plastic. The handrail assembly 100 may comprise a strong but lightweight flexible plastic tubing 110 that will not decrease in strength after months of repeated use and can endure substantial weight. The tubing 110 can have any appropriate cross-sectional profile, such as, for example, circular, square, or any other profile.

For example, the tubing 110 can be pipe comprising polyvinyl chloride (PVC) polyamide, polyurethane, polyethylene, polypropylene, acrylonitryl-butadiene-styrene (ABS), polycarbonate, chloronated polyvinyl chloride (CPVC), an acrylic polymer and alumina trihydrate material sold as CORIAN® by the Dupont Corporation of Wilmington, DE, or the like, or combinations of two or more of these materials. The handrail assembly 100 can include a single length of tubing 110, or a plurality of lengths of tubing 110 joined end-to-end with each other.

The handrail assembly 100 can be secured to a wall 102 with external supports 150. Each support 150 has a flat plate or flange 152 for mounting the support 150 to the wall 102. In some embodiments, the supports 150 comprise heavy duty plastic, such as PVC, polyurethane, polyethylene, ABS, polycarbonate or the like. In other embodiments, the supports 150 comprise a metallic material, such as aluminum, steel, stainless steel, or any other appropriate material.

Figure 3:
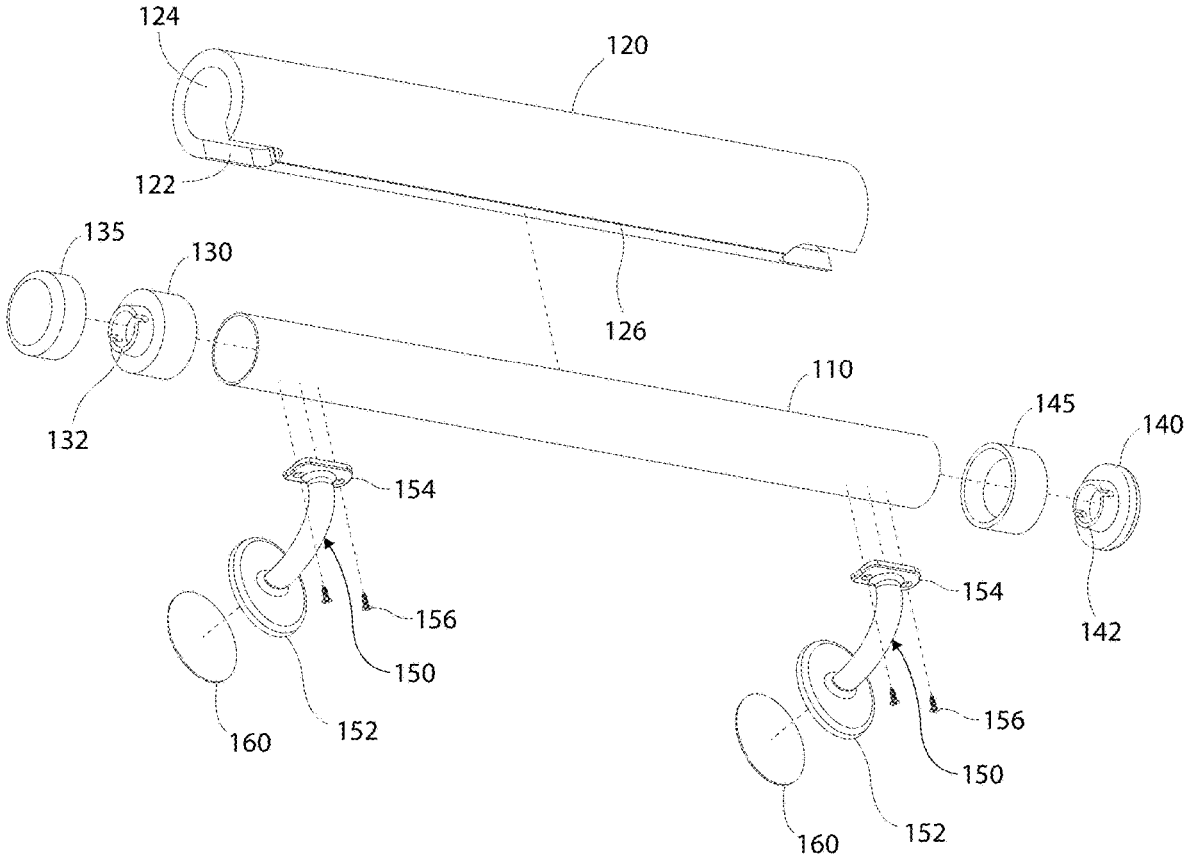
FIG. 3 is an exploded view of the assembly of FIG. 2.

In some embodiments, as shown in FIG. 3, an adhesive 160—such as a pressure sensitive adhesive—is used to detachably secure the supports 150 to the wall 102. The pressure sensitive adhesive 160 can include an elastomer compounded with a suitable tackifier (e.g., a rosin ester). The elastomers can be based on acrylics, bio-based acrylate, butyl rubber, ethylene-vinyl acetate (EVA) with high vinyl acetate content; natural rubber, nitriles, or silicone rubbers. The adhesive can include styrene block copolymers (SBC), resins associating with endblocks (cumarone-indene, α-methyl styrene, vinyl toluene, aromatic hydrocarbons, etc.), resins associating to the midblocks (aliphatic olefins, rosin esters, polyterpenes, terpene phenolics), styrene-butadiene-styrene (SBS), styrene-ethylene/butylene-styrene (SEBS), styrene-ethylene/propylene (SEP), styrene-isoprene-styrene (SIS), vinyl ethers, or combinations thereof. In some embodiments, the supports 150 of the handrail assembly 100 can be attached to the wall 102 using the adhesive 160, without screws or nails, so that the handrail assembly 100 can be detached and/or moved one or more times without damaging the wall 102.

Figure 4:
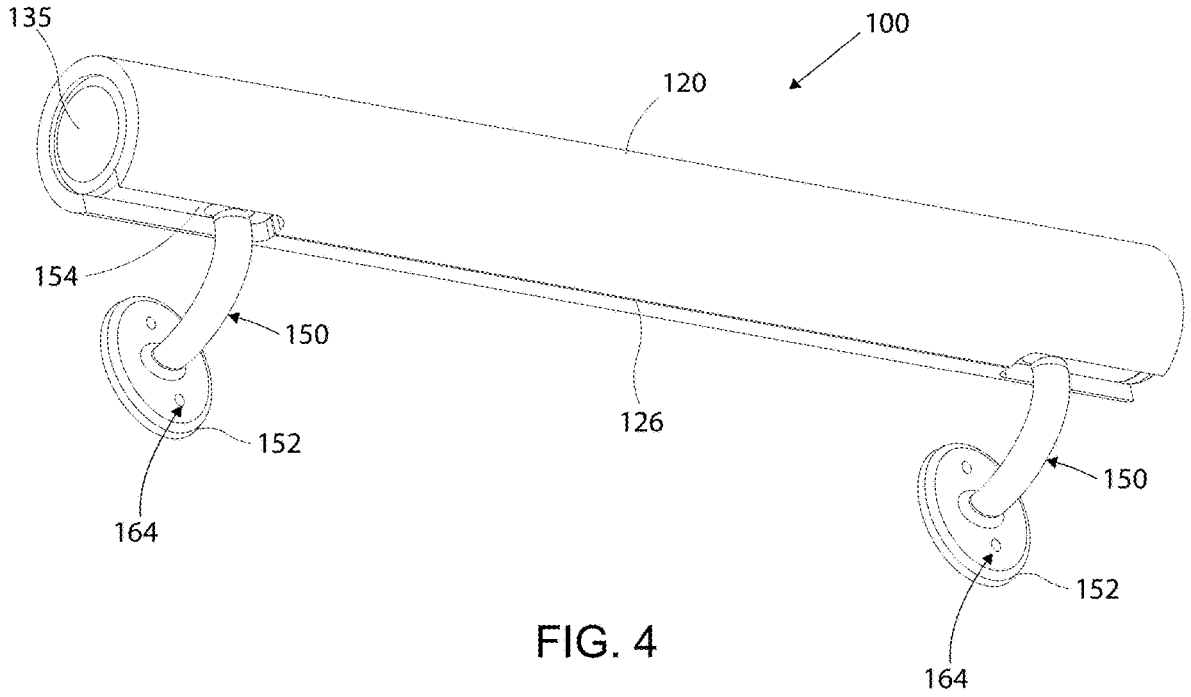
FIG. 4 is an isometric view of a handrail assembly, according to another embodiment.
Figure 5:
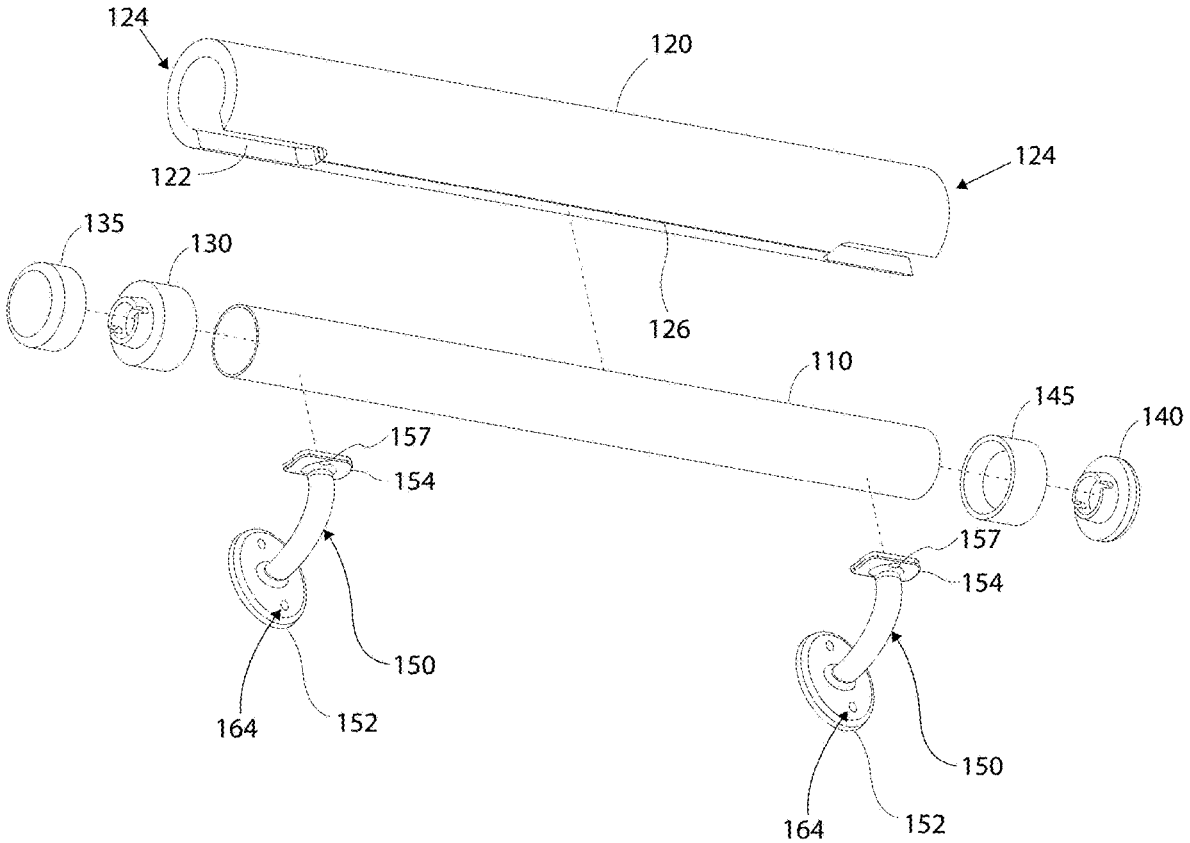
FIG. 5 is an exploded view of the handrail assembly of FIG. 4.
Figure 6A:
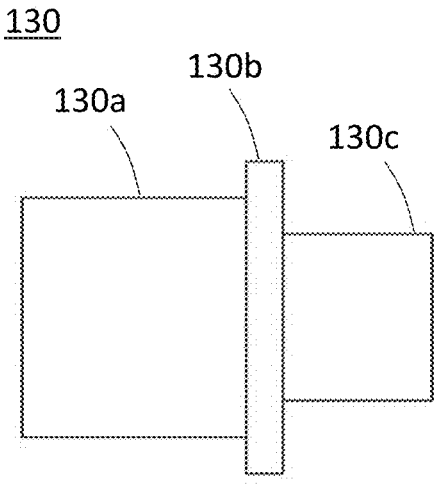
FIGS. 6A-6D are top, side, front, and isometric views, respectively, of a male connector, according to embodiments described herein.
Figure 6B:
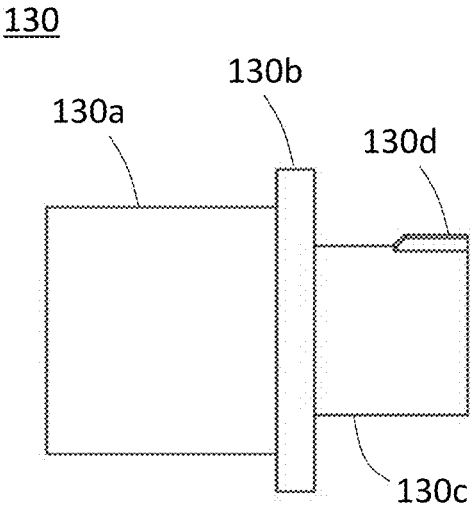
Figure 6C:
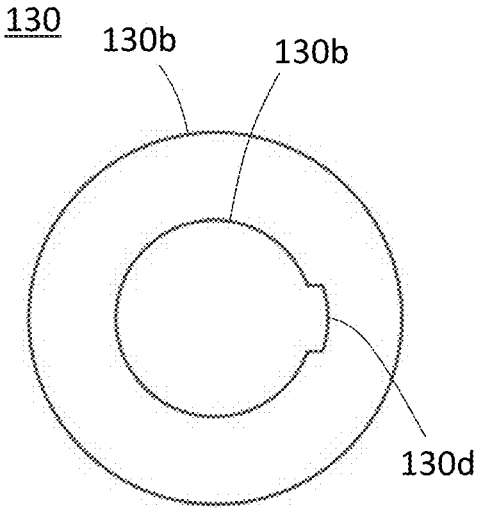
Figure 6D:
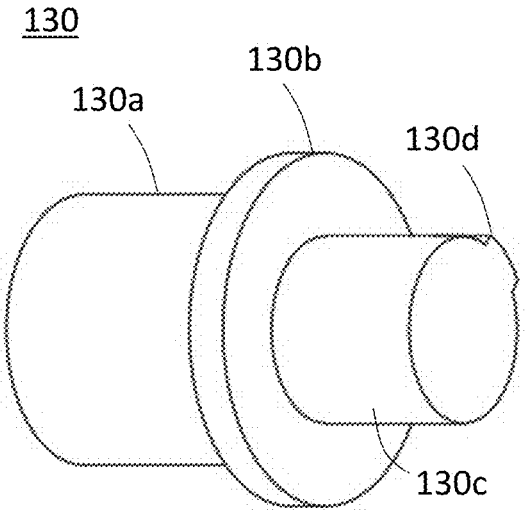
Figure 7A:
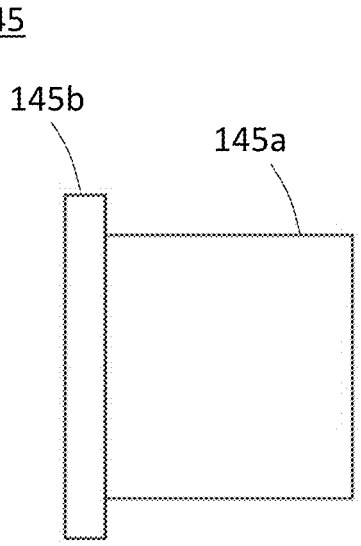
FIGS. 7A-7D are top, front isometric, end, and rear isometric views, respectively, of a female connector, according to embodiments described herein.
Figure 7B:
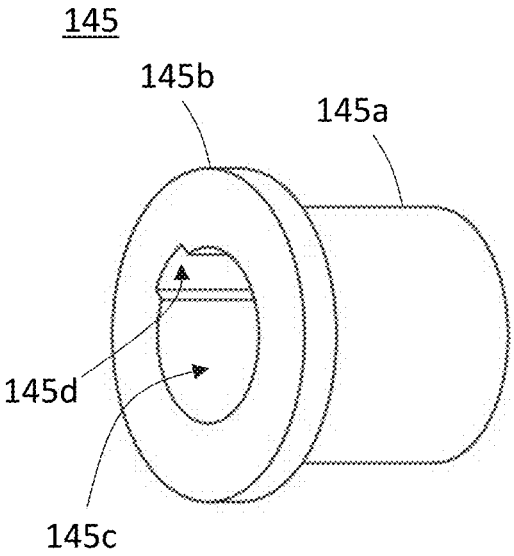
Figure 7C:
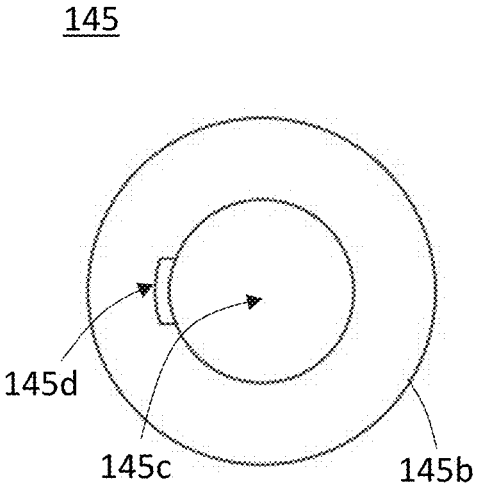
Figure 7D:
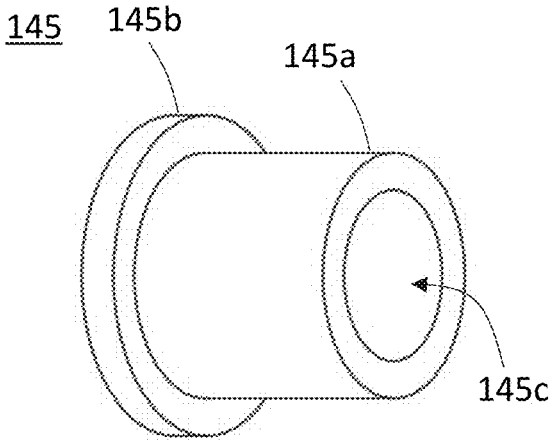
Figure 8A:
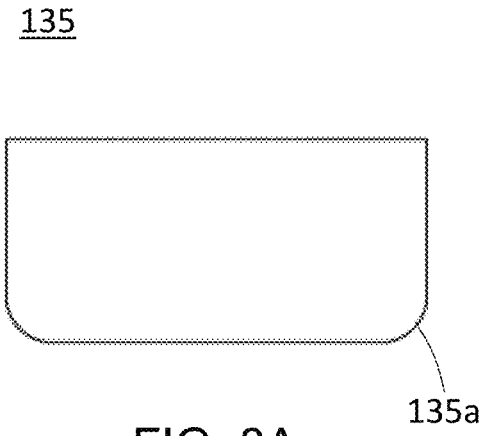
FIGS. 8A-8D are top, front isometric, end, and rear isometric views, respectively, of a cap, according to embodiments described herein.
Figure 8B:
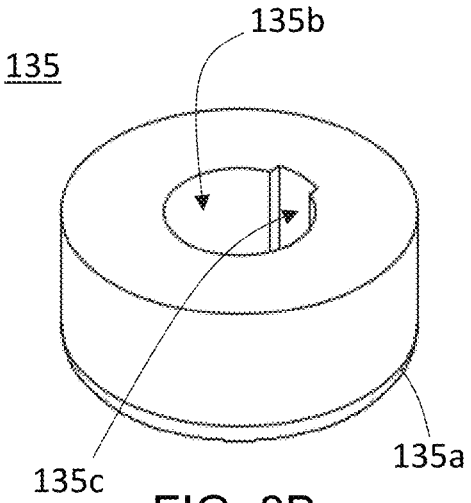
Figure 8C:
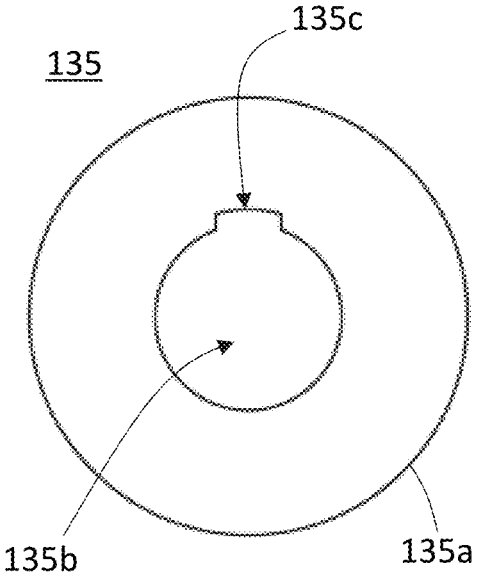
Figure 8D:
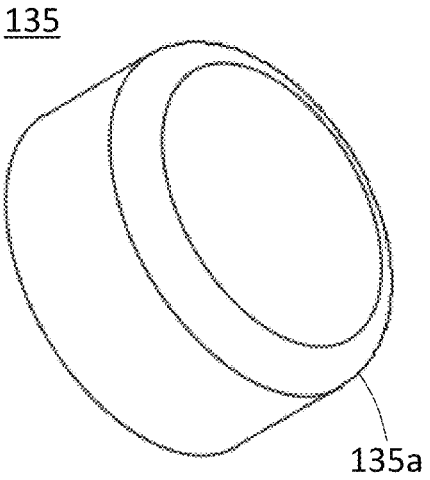
Figure 9A:
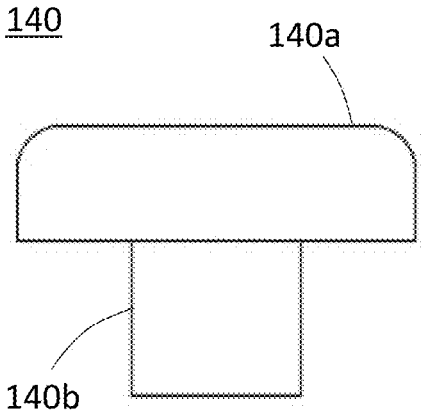
FIGS. 9A-9D are top, side, front, and isometric views, respectively, of a plug, according to embodiments described herein.
Figure 9B:
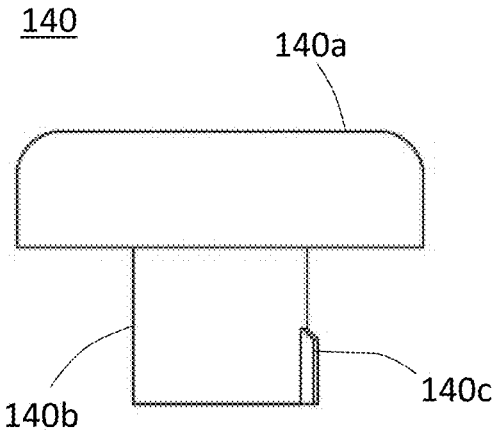
Figure 9C:
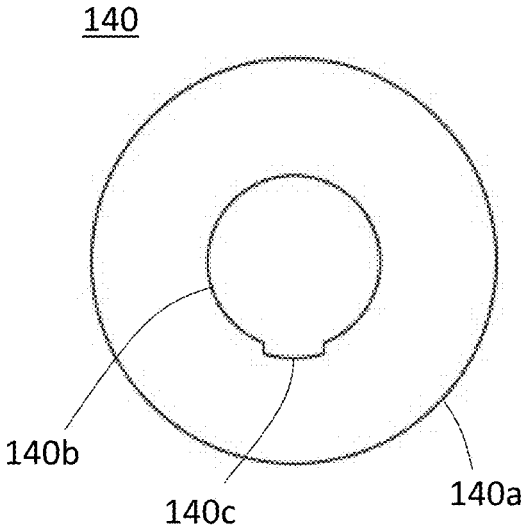
Figure 9D:
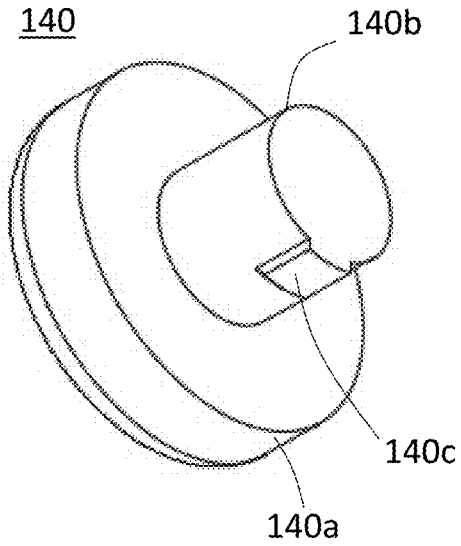

As shown in FIGS. 4 and 5, in other embodiments, the supports 150 can be attached to the wall 102 using fasteners, such as screws (not shown). The supports 150 may include apertures 164 through the flanges 152 to receive the fasteners. When mounting the handrail assembly 100 to the wall 102, the installer may insert the fasteners through the apertures 164 and into the wall 102 to secure the handrail assembly 100 to the wall 102. In some embodiments, the supports 150 are spaced along the tubing 110 such that the fasteners may be inserted into studs in the wall 102 to provide a more secure engagement. In other embodiments, drywall anchors may be used to retain the fasteners in the wall 102.

The supports 150 have a second flange 154 for attaching the tubing 110 to the supports 150. In some embodiments, the second flanges 154 are joined to the tubing 110 using fasteners 156 (e.g., screws) (shown in FIG. 3). The fasteners 156 may permanently join the second flanges 154 to the tubing 110. Alternatively, the fasteners 156 may removably join the second flanges 154 to the tubing 110. The fasteners 156 may be inserted upward through the supports 150 such that the threaded portion of the fasteners 156 engage the tubing 110. Alternatively, the fasteners may be inserted downward through the tubing 110 such that the threaded portions of the fasteners 156 engage threaded holes in the supports 150 (e.g., holes 157 shown in FIG. 5). Alternatively, or additionally, the second flanges 154 may be joined to the tubing 110 using a plastic welding adhesive, epoxy, or glue. In some embodiments, each section of tubing 110 has a respective set of supports 150. Therefore, the supports 150 may be permanently attached to tubing 110 while still allowing sections of tubing 110 to be coupled and decoupled.

The elongated sections of tubing 110 have a suitable thickness and strength to prevent bending or breakage. For example, the wall thickness of the sections 301, 302 can be in a range from 0.09 inch (2.4 mm) to 0.25 inch (6.4 mm). The sections of tubing 110 may also be any appropriate length.

Figure 1B:
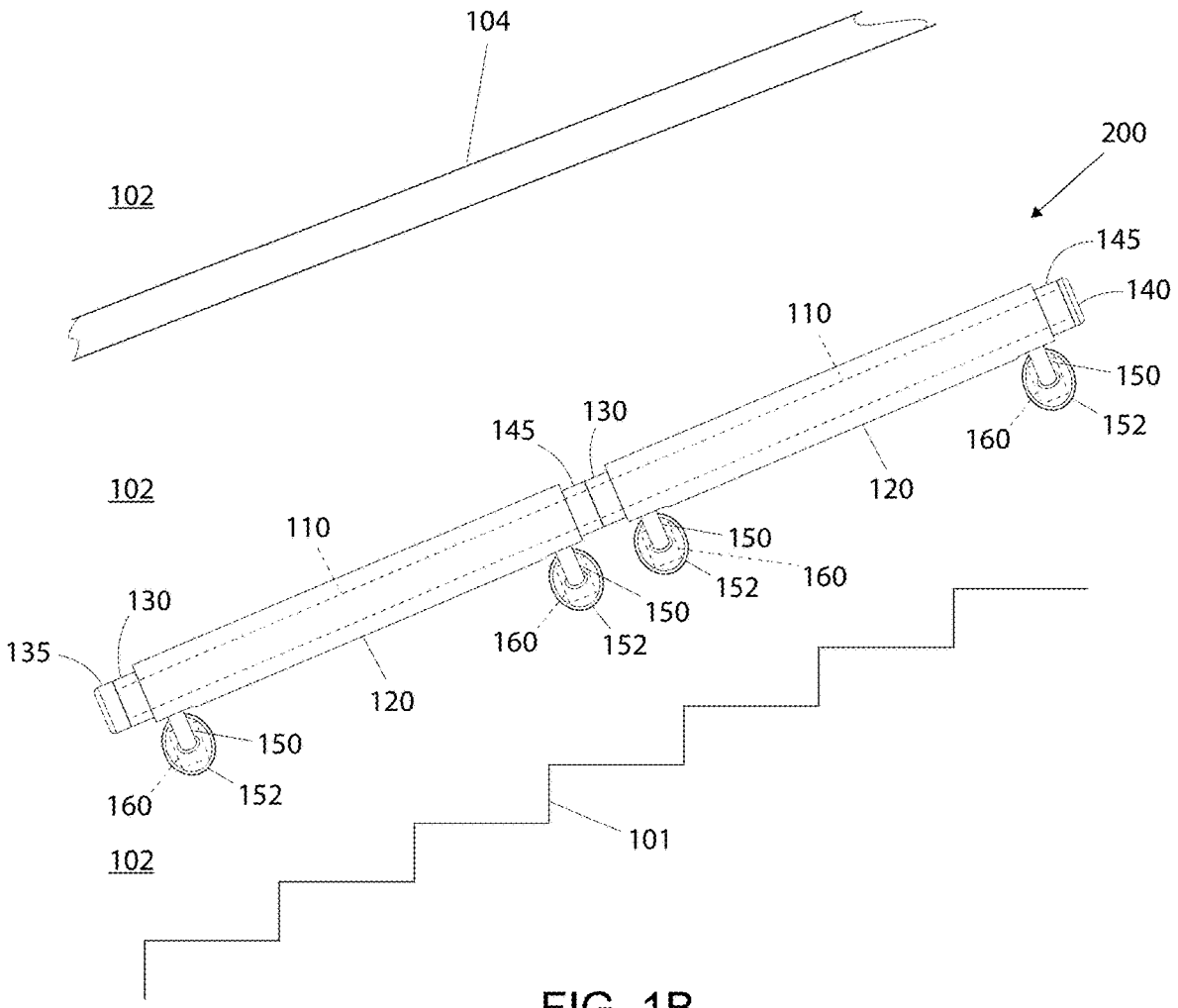
FIG. 1B is a diagram of an installed handrail assembly having multiple sections.

In some embodiments, as shown in FIG. 1B, a handrail assembly 200 comprises a plurality of sections of tubing 110. For example, the handrail assembly 200 can include two, three or more sections of tubing 110. For example, as shown in FIG. 1B, each section of tubing 110 in the handrail assembly 200 can have a male connector 130 at one end and a female connector 145 at the opposite end, permitting any desired number of sections of tubing 110 to be assembled without using any tools. One embodiment of the male connector 130 is shown in detail in FIGS. 6A-6D and is described below. One embodiment of the female connector 145 is shown in FIGS. 7A-7D and is described below. In some embodiments, the connectors 130, 145 are threaded such that they can threadably engage to connect sections of tubing 110. In other embodiments (not shown), the sections of tubing 110 can be joined using threaded or unthreaded sleeves. In some examples, the sections of tubing 110 have male connectors 130 at each end, and a sleeve having apertures at each end configured to receive portions of the male connectors to join two sections together. In other examples, the sections of tubing 110 are joined by a sleeve with glue, plastic cement, or a resin system. In other embodiments (not shown), the sections of tubing 110 can be joined by bayonet fittings, compression fittings, or the like.

Figure 2:
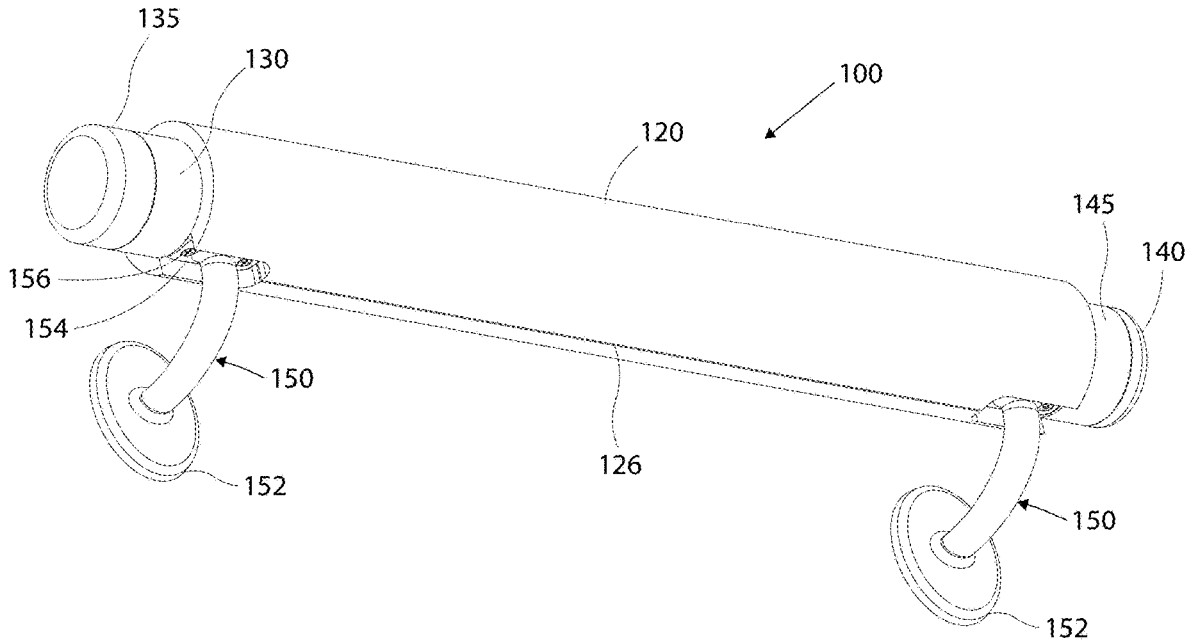
FIG. 2 is an isometric view of the handrail assembly of FIG. 1A.

FIG. 2 is an isometric view of a handrail assembly having a single section. FIG. 3 is an exploded view of the handrail assembly 100 of FIG. 2. The tubing 110 is encased in a deformable foam sleeve 120. The foam sleeve 120 can be a closed cell polymeric foam, such as a low-resilience polyurethane foam (LRPu) ("viscoelastic" polyurethane foam) that matches pressure against it, yet slowly springs back to its original shape, also referred to as memory foam. In other embodiments, the sleeve 120 comprises expanded polystyrene (EPS), extruded polystyrene (XPS), polystyrene copolymers (including styrene plus one or more other monomers), or expanded polystyrene composites containing cellulose or starch. In other embodiments, the sleeve 120 comprises polyolefin foam. Alternatively, the sleeve 120 can comprise a closed cell sponge rubber and plastic foam such as DURAFOAM™ foam sold by Monmouth Rubber & Plastics Corp. of Long Branch, NJ. In other embodiments, the sleeve 120 can comprise a non-woven felt material.

In various embodiments, a sleeve 120 comprising any of the above materials can be coated with an anti-microbial coating. A foam sleeve 120 with antimicrobial coating acts as a protective covering that provides a comfortable and firm grip for the child. The antimicrobial coating on the sleeve 120 can also prevent the spreading of germs and inhibits microorganisms from growing. For example, in some embodiments, the sleeve 120 comprises antimicrobial coated DURAFOAM™ closed cell sponge rubber and plastic foam. The result is a comfortable, easy-to-grip, non-slip, moisture-resistant sleeve 120, which is easy to clean.

The sleeve 120 can include one or more sleeve sections. In some embodiments (not shown), the sleeve 120 is a single piece having a continuous circumference. In other embodiments (not shown), the sleeve 120 can comprise a plurality of sleeve sections, where each sleeve section is shorter than the complete handrail assembly 100. These shorter sleeve sections may be easier to slide longitudinally over the tubing 110 of handrail 100, because of smaller contact area per sleeve section. In some embodiments, as shown in FIG. 4, each sleeve 120 may extend to the end of each section of tubing 110 and cover the connectors 130, 145 and, when installed, the covering components 135, 140. Hence, adjacent sleeves 120 may abut one another such that there are not gaps between the sleeves 120. In some embodiments, a socket, fitting covering, or tape may be placed over the abutting ends of (or gap between) two adjacent sleeve sections, for protection.

In other embodiments, as shown in FIGS. 2 and 3, the sleeve 120 can have a longitudinal slit 126 extending from the inner diameter of the sleeve 120 through the wall of the sleeve 120 to the outer diameter of the sleeve 120, and running the entire length of the sleeve 120. The sleeve 120 having a slit 126 can easily be wrapped or pushed over the side wall of the tubing 110. In some embodiments, each end 124 of the sleeve 120 has a respective support-receiving slot 122 for receiving the arm of the support 150. The support-receiving slots 122 allow the sleeve 120 to be installed around the tubing section 110 while the handrail assembly is already installed on the wall 102. In some embodiments, the sleeve 120 is secured to the tubing 110 using glue or other adhesives. This may prevent the sleeve 120 from moving relative to the tubing 110 during use, which may increase the safety of the handrail 100. In such embodiments, the sleeve 120 may be glued or adhered to the tubing 110 during manufacturing or, alternatively, by the user at the time of assembly and installation. In some such embodiments, an adhesive and backing paper is applied to the tubing 110 or the sleeve 120 during manufacturing and the user removes the backing paper and affixes the sleeve 120 to the tubing 110 during assembly and installation.

As shown in FIGS. 6A-6D, male connector 130 may include a cylindrical body 130*a*, a flange 130*b*, and a male projection 130*c*. The cylindrical body 130*a* is configured to be inserted into the tubing section 110 such that the flange 130*b* abuts the end of the tubing section 110. The outer diameter of the flange 130*b* may be about the same as the outer diameter of tubing 110. The male projection 130*c* extends outward from the flange 130*b* and is configured to engage an aperture in the female connector 145 (as shown in detail in FIGS. 7A-7D). In some embodiments, the male projection 130*c* includes a key 130*d* configured to engage a keyway in the female connector 145 to prevent relative rotation of the connectors 130, 145. In some embodiments, the male connector 130 is coupled to the tubing section 110 using adhesive, such as epoxy. Although in the illustrated embodiment the male connector 130 has a cylindrical body 130*a*, it should be understood that the male connector 130 can take on any appropriate shape and may match the profile of tubing 110.

As shown in FIGS. 7A-7D, the female connector 145 includes a cylindrical body 145*a*, a flange 145*b*, and an aperture 145*c* formed in the cylindrical body 145*a*. The cylindrical body 145*a* is configured to be inserted into the tubing section 110 such that the flange 145*b* abuts the end of the tubing section 110. The outer diameter of the flange 145*b* may be about the same as the outer diameter of tubing 110. The aperture 145*c* is configured to receive the male projection 130*c* of the male connector 130 to couple multiple sections of tubing 110. In various embodiments, the aperture 145*c* includes a keyway 145*d* configured to receive the key 130*d* of the male connector 130. In some embodiments, the female connector 145 is coupled to the tubing section 110 using adhesive, such as epoxy. Although in the illustrated embodiment the female connector 145 has a cylindrical body 145*a*, it should be understood that the female connector 145 can take on any appropriate shape and may match the profile of tubing 110.

The use of a modular design allows multiple sections of the plastic tubing 110 to be joined to increase the length of the handrail assembly 200 to accommodate any size of staircase 101. The external supports 150 can be "L" or arch shaped to allow a user to slide his/her hand up and down the cylindrical tubing 110 without interference. The supports 150 may have extended and raised portions to provide clearance for the user's hand. Each end of cylindrical handrail assembly 100 or 200 may include a fitted covering component 135, 140, which couple to connecting members 130, 145 to cover the open ends of cylindrical tubing sections 110 that are not functioning as a connector member between adjoining sections of tubing 110 of a multi-section handrail assembly 200. For example, the covering component 135 can be a cap covering an exposed male connector 130 and the covering component 140 can be a plug filling an exposed female connector 145. In other embodiments, the cap 135 and/or plug 140 have a "snap fit" connector that locks securely in place.

In one embodiment, an adjustable walking device/handrail assembly 100 includes an elongated, lightweight cylinder of tubing 110 encased in an antimicrobial coated memory foam sleeve 120. The anti-microbial memory foam outer sleeve 120 on the tubing 110 conforms and molds to the shape of the toddler's hand, which allows the child's grip to be firm and comfortable. The handrail assembly 100 aids toddlers/children by providing support to ascend and descend a staircase 101. The handrail assembly 100 may assist toddlers in improving their balance.

In some embodiments, the handrail assembly 100 includes a non-screw type wall mounting 160 which makes the handrail assembly 100 easily detachable and re-locatable. The support 150 can include a flange 152 with a pressure-sensitive adhesive 160. In various embodiments, the handrail assembly 100 has no mechanical or magnetic connection or association with an existing permanent handrail 104 (FIGS. 1A, 1B). In addition, there may not be a need for any separate hanging apparatus in the handrail assembly 100. This may allow the handrail assembly 100 to be positioned and re-positioned independently of the location of the permanent handrail 104. In some embodiments, as shown in FIGS. 1A and 1B, the handrail assembly 100 does not require permanent attachment by screws, nails or other mechanical fasteners to avoid damage to a wall 102. The handrail assembly 100 is easy to clean, assemble and disassemble.

In some embodiments, a vertically elongated cylindrical plastic tube 110 is encased in antimicrobial coated "DURAFOAM™" closed cell sponge rubber and plastic foam or an LRPu memory foam sleeve 120 that spans the length of the staircase 101. The handrail assembly 100 can include one or more tubing sections 110, each having a first end and a second end. Each section of tubing 110 can include a male connector 130 at one end and a female connector 145 at an opposite end. The male and female connectors 130, 145 can fasten to the tubing section 110 or to one another. Any desired number of sections of tubing 110 having female 145 and male 130 connectors can be assembled together to add length to match the length of an existing permanent handrail 104 in the desired area of placement. In other embodiments, each end of the tubing sections 110 includes a fitted covering component (e.g., cap 135 or plug 140) to cover the free end thereof.

FIGS. 8A-8D show one embodiment of the cap 135. The cap 135 includes a body 135*a* and an aperture 135*b* formed in the body 135*a*. The aperture 135*b* is configured to receive the male projection 130*c* of the male connector 130. The aperture 135*b* may also include a keyway 135*c* configured to receive the key 130*d* of the male connector 130. In this way, the cap 135 may be used to cover the male projection 130*c* when the male connector 130 is not used to connect to other sections of tubing 110. The body 135*a* may have an outer diameter that is about the same as the outer diameter of the tubing 110. Although in the illustrated embodiment the cap 135 has a cylindrical body, it should be understood that the cap 135 can take on any appropriate shape and may match the profile of the tubing 110.

FIGS. 9A-9D show one embodiment of the plug 140. The plug 140 includes a cylindrical body 140*a* and a projection 140*b*. The projection 140*b* is configured to engage the aperture 145*c* in the female connector 145 to cover the aperture 145*c* when the female connector 140 is not connected to a male connector 130. The plug 140 may further include a key 140*c* configured to engage the keyway 145*d* in the female connector 145. The cylindrical body 140*a* may have an outer diameter that is about the same as the outer diameter of the tubing 110. Although in the illustrated embodiment the plug 140 has a cylindrical body, it should be understood that the plug 140 can take on any appropriate shape and may match the profile of the tubing 110.

Features and advantages of the embodiments will become apparent from specifications of drawings by way of illustration, which are individually obtained by various embodiments and features of the drawings.

Operation

In various embodiments, the user assembles the handrail assembly 100 prior to mounting the handrail assembly 100 to the wall. In embodiments in which more than one section of tubing is desired, the user joins two or more tubing sections 110 by inserting the male projection 130*c* of male connector 130 into the aperture 145*c* of the female connector 145, for example. The cap 135 may then be placed over the exposed male connector 130, and the plug 140 is placed in the open female connector 145. The foam sleeve 120 is placed over the tubing 110. The sections of foam 120 can slide longitudinally over the tubing 110, or the foam sleeve 120 is slit longitudinally (with a longitudinal slit 126) and is wrapped around the tubing 120. The tubing 110 is then attached to the supports 150.

The handrail assembly 100 is then attached to the wall 102 above the stairs 101. In embodiments having adhesive 160, release paper (not shown) may be removed from the pressure sensitive adhesive 160. The flanges 152 may then be pressed against the wall 102 to couple the handrail assembly 100 to the wall 102. In embodiments, such as shown in FIGS. 4 and 5, in which fasteners are used to mount the handrail assembly 100 to the wall 102, the fasteners are inserted through the holes 164 in the supports 150 and inserted into the wall 102.

In some embodiments, the length of the tubing 110 is selected to extend beyond the top and bottom steps, and is attached at either end to a support fixture (which can be one of the supports 150, for example) using a pressure-sensitive adhesive or fasteners to mount the handrail assembly 100. In some embodiments, the tubing sections 110 are positioned approximately 1.5 inches away from the wall when the handrail assembly 100 is mounted.

To remove the handrail assembly 100 from the supports 150, the male and female connecters 130, 145 of the tubing sections 110 are decoupled. In embodiments in which adhesive 160 is used to mount handrail assembly 100 to the wall 102, the supports 150 are removed from the wall 102 by tugging on them gently till they become loose. In embodiments in which fasteners are used to attach the handrail assembly 100 to the wall, the fasteners are removed from the wall to allow the handrail assembly 100 to be removed and, optionally, to be repositioned.

It should be understood that the steps of assembling, mounting, and removing may be performed in any order. For example, a single section of tubing 110 and associated supports 150 may be mounted to the wall 102. A second section of tubing 110 may then be coupled to the first section of tubing 110 and mounted to the wall 102. Further, the cap 135 and plug 140 may be assembled to the assembly after all of the sections of tubing 110 are mounted to the wall 102.

Although the subject matter has been described in terms of exemplary embodiments, it is not limited thereto. Rather, the appended claims should be construed broadly, to include other variants and embodiments, which may be made by those skilled in the art. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention.

The invention claimed is:

1. A handrail assembly for a child comprising:

an elongated plastic tube having a first end and a second end;

a low-resilience polyurethane memory foam sleeve having a first end and a second end configured to be positioned around the elongated plastic tube; and a plurality of supports configured to be attached to the elongated plastic tube, each of the plurality of supports including a respective first flange configured to be detachably secured against a wall and a respective second flange configured to be detachably secured against the elongated plastic tube adjacent the first and second ends, respectively, wherein the low-resilience polyurethane memory foam sleeve includes a longitudinal slit extending from the inner diameter of the sleeve through the wall of the sleeve to the outer diameter of the sleeve and a pair of end receiving slots communicating with the longitudinal slit, each extending from said first and second ends of the foam sleeve, respectively, and each configured to receive the respective second flange of the plurality of supports, the slit and receiving slots are configured to allow the foam sleeve to wrap over the elongated tube while the plurality of supports are attached to the elongated plastic tube such that the second flanges of the pair of supports are substantially surrounded, and wherein the plurality of supports each include a pressure sensitive adhesive coupled to the respective flange, the pressure sensitive adhesive configured to couple the handrail assembly to the wall adjacent to a staircase, without screws or nails, so that the handrail assembly can be detached and moved one or more times without damaging the wall, whereby the height of the handrail assembly is adjustable, to provide support for the child in ascending and descending the staircase.

2. The handrail assembly of claim 1, further comprising a male connector configured to couple to an end of the elongated tube, wherein the male connector is configured to engage a female connector coupled to a second elongated tube.

3. The handrail assembly of claim 2, wherein the male connector includes a male projection having a key, and wherein the male projection and key are configured to engage an aperture and keyway of the female connector such that relative rotation of the male connector and female connector is restricted.

4. The handrail assembly of claim 3, further comprising a cap configured to couple to the male connector to cover a portion of the male connector.

5. The handrail assembly of claim 1, further comprising a female connector configured to couple to an end of the elongated tube, wherein the female connector is configured to engage a male connector coupled to a second elongated tube.

6. The handrail assembly of claim 5, further comprising a plug configured to engage the female connector and cover an opening in the female connector.

7. The handrail assembly of claim 1, wherein the pressure sensitive adhesive is a bio-based acrylate pressure sensitive adhesive.

8. A handrail assembly for a child comprising:

an elongated plastic tube comprising a plurality of tubular plastic sections joined end-to-end, each tubular plastic section having a male connector at a first end and a female connector at a second end opposite the first end, wherein the male connector of a first tube is configured to engage a female connector of a second tube; and a plurality of supports attached to the elongated plastic tube, each of the plurality of supports including a respective first flange configured to be detachably secured to a wall and a respective second flange configured to be detachably secured against the elongated plastic tube adjacent the first and second ends, respectively, said handrail assembly further comprising a low-resilience polyurethane memory foam sleeve around a circumference of the elongated plastic tube, wherein the foam sleeve includes a longitudinal slit extending from the inner diameter of the sleeve through the wall of the sleeve to the outer diameter of the sleeve and a pair of end receiving slots communicating with the longitudinal slit, each extending from first and second ends of the foam sleeve, respectively, and each configured to receive the respective second flange of the plurality of supports, the slit and receiving slots are configured to allow the foam sleeve to wrap over the elongated tube while the plurality of supports are attached to the elongated plastic tube such that the second flanges of the pair of supports are substantially surrounded, and wherein the plurality of supports each include a pressure sensitive adhesive coupled to the respective flange, the pressure sensitive adhesive configured to couple the handrail assembly to the wall adjacent to a staircase, without screws or nails, so that the handrail assembly can be detached and moved one or more times without damaging the wall, whereby the height of the handrail assembly is adjustable, to provide support for the child in ascending and descending the staircase.

9. The handrail assembly of claim 8, wherein the male connector includes a male projection having a key, and wherein the male projection and key are configured to engage an aperture and keyway of the female connector such that relative rotation of the male connector and female connector is restricted.

10. The handrail assembly of claim 8, wherein the pressure sensitive adhesive is a bio-based acrylate pressure sensitive adhesive.

11. A method comprising:

assembling a plurality of tubular sections to form an elongated plastic tube having a first end and a second end;

attaching the elongated tube to a plurality of supports;

detachably securing the plurality of supports to a wall at a first location between a set of steps and a stair rail, wherein each of the plurality of supports includes a respective first flange detachably secured against a wall and a respective second flange detachably secured against the elongated plastic tube adjacent the first and second ends, respectively; and attaching a low-resilience polyurethane memory foam sleeve around a circumference of the elongated plastic tube, wherein the foam sleeve includes a longitudinal slit extending from the inner diameter of the sleeve through the wall of the sleeve to the outer diameter of the sleeve and a pair of end receiving slots communicating with the longitudinal slit, each extending from said first and second ends of the foam sleeve, respectively, and each configured to receive the respective second flange of the plurality of supports, wherein the slit and receiving slots are configured to allow the foam sleeve to wrap over the elongated tube while the plurality of supports are attached to the elongated plastic tube such that the second flanges of the pair of supports are substantially surrounded, and the plurality of supports each include a pressure sensitive adhesive coupled to a respective flange of a handrail assembly adjacent to a staircase, the pressure sensitive adhesive configured to couple the respective flange to the wall, without screws or nails, so that the handrail assembly can be detached one or more times without damaging the wall, whereby the height of the handrail assembly is adjustable, to provide support for a child in ascending and descending the staircase.

12. The method of claim 11, wherein assembling the plurality of tubular sections includes coupling a male connector coupled to an end of a first tubular section with a female connector coupled to an end of a second tubular section.

13. The method of claim 11, wherein the pressure sensitive adhesive is a bio-based acrylate pressure sensitive adhesive.

* * * * *